US012044517B2

(12) United States Patent
Bailey

(10) Patent No.: US 12,044,517 B2
(45) Date of Patent: Jul. 23, 2024

(54) METHOD AND APPARATUS FOR CONTROLLING A HAZARDOUS DEVICE

(71) Applicant: Environmental Defence Systems Limited, Huddersfield (GB)

(72) Inventor: Richard J. Bailey, Huddersfield (GB)

(73) Assignee: Environmental Defence Systems Limited, Huddersfield (GB)

( * ) Notice: Subject to any disclaimer, the term of this patent is extended or adjusted under 35 U.S.C. 154(b) by 0 days.

(21) Appl. No.: 17/876,146

(22) Filed: Jul. 28, 2022

(65) Prior Publication Data

US 2022/0364840 A1 Nov. 17, 2022

Related U.S. Application Data

(63) Continuation of application No. 16/733,327, filed on Jan. 3, 2020, now abandoned, which is a continuation
(Continued)

(30) Foreign Application Priority Data

| | | |
|---|---|---|
| Apr. 8, 2014 | (GB) | 1406351 |
| Jul. 28, 2014 | (GB) | 1413334 |
| Dec. 1, 2014 | (GB) | 1421312 |

(51) Int. Cl.
*F42D 5/00* (2006.01)
*B65D 1/34* (2006.01)
(Continued)

(52) U.S. Cl.
CPC ..... *F42D 5/045* (2013.01); *B65D 1/34* (2013.01); *B65D 81/264* (2013.01)

(58) Field of Classification Search
CPC ..... E02B 3/108; E02B 3/127; F42D 5/045
(Continued)

(56) References Cited

U.S. PATENT DOCUMENTS

| | | | |
|---|---|---|---|
| 4,543,872 A | 10/1985 | Graham et al. | |
| 4,836,079 A | 6/1989 | Barrett | |

(Continued)

FOREIGN PATENT DOCUMENTS

| | | | |
|---|---|---|---|
| EP | 1947247 A2 * | 7/2008 | ..... E02B 3/108 |
| EP | 1947247 A2 | 7/2008 | |

(Continued)

OTHER PUBLICATIONS

International Search Report for International Patent Application No. PCT/GB2015/051055 dated May 28, 2015, 3 pages.

(Continued)

*Primary Examiner* — Eyamindae C Jallow
(74) *Attorney, Agent, or Firm* — Howard & Howard Attorneys PLLC

(57) ABSTRACT

A method of controlling a hazardous device comprising the steps of providing a combination of a barrage unit and a container for holding a liquid, the container being adapted to receive the barrage unit, the barrage unit comprising at least one pad, the pad comprising an absorbent fibrous material and an absorbent crystalline material; arranging the hazardous device and barrage unit in the container with the barrage unit at feast partially covering the hazardous device; and, adding a liquid to the container so that the barrage unit absorbs the liquid.

20 Claims, 6 Drawing Sheets

Related U.S. Application Data of application No. 15/302,578, filed as application No. PCT/GB2015/051055 on Apr. 7, 2015, now abandoned.

(51) Int. Cl.
*B65D 81/26* (2006.01)
*F42D 5/045* (2006.01)

(58) Field of Classification Search
USPC ..... 109/26
See application file for complete search history.

(56) References Cited

U.S. PATENT DOCUMENTS

| | | | | |
|---|---|---|---|---|
| 4,964,329 | A * | 10/1990 | Moxon | F42D 1/26 102/305 |
| 5,040,919 | A | 8/1991 | Hendrix | |
| 5,044,252 | A | 9/1991 | Gamadi et al. | |
| 6,289,816 | B1 * | 9/2001 | Keenan | F42B 39/16 102/303 |
| 6,302,026 | B1 * | 10/2001 | Parkes | F42D 5/045 102/303 |
| 6,439,120 | B1 | 8/2002 | Bureaux et al. | |
| 7,313,994 | B1 * | 1/2008 | Lacombe | F42D 5/045 102/303 |
| 7,520,223 | B2 * | 4/2009 | Sharpe | F42D 5/045 102/303 |
| 8,327,778 | B2 | 12/2012 | DelloRusso, Jr. | |
| 9,657,452 | B2 | 5/2017 | Bailey | |
| 9,909,834 | B1 | 3/2018 | Wilhelm et al. | |
| 10,184,771 | B2 | 1/2019 | Bailey | |
| 10,539,404 | B1 | 1/2020 | Lustig et al. | |
| 10,739,113 | B1 | 8/2020 | Bosen et al. | |
| 2004/0094026 | A1 | 5/2004 | Efim et al. | |
| 2006/0210360 | A1 | 9/2006 | Slater et al. | |
| 2008/0250916 | A1 | 10/2008 | Bailey | |
| 2013/0146603 | A1 | 6/2013 | Brilmyer | |
| 2017/0030696 | A1 | 2/2017 | Bailey | |
| 2020/0217636 | A1 | 7/2020 | Bailey | |

FOREIGN PATENT DOCUMENTS

| | | | | |
|---|---|---|---|---|
| GB | 2355057 | A | 4/2001 | |
| WO | 03067177 | A1 | 8/2003 | |
| WO | 03067178 | A1 | 8/2003 | |
| WO | WO2005085746 | A1 | 9/2005 | |
| WO | 2011061539 | A1 | 5/2011 | |
| WO | 2015155514 | A1 | 10/2015 | |
| WO | 2016050346 | A1 | 4/2016 | |
| WO | WO-2016050346 | A1 * | 4/2016 | F42D 5/045 |

OTHER PUBLICATIONS

United Kingdom Search Report for Application No. GB1505879.5 dated May 19, 2015, 1 page.

* cited by examiner

METHOD AND APPARATUS FOR CONTROLLING A HAZARDOUS DEVICE

The subject patent application is a continuation application of U.S. patent application Ser. No. 16/733,327, filed on Jan. 3, 2020, which is a continuation application of U.S. patent application Ser. No. 15/302,578, filed on Oct. 7, 2016, which is the National Stage of International Patent Application No. PCT/GB2015/051055, filed on Apr. 7, 2015, which claims priority to and all the advantages of Great Britain Patent Application No. 1406351.5, filed on Apr. 8, 2014, Great Britain Patent Application No. 1413334.2, filed on Jul. 28, 2014, and Great Britain Patent Application No. 1421312.8, filed on Dec. 1, 2014. The contents of International Patent Application No. PCT/GB2015/051055 and Great Britain Patent Application Nos. 1406351.5, 1413334.2, and 1421312.8 are incorporated herein by reference in their entirety.

The present invention relates to a method and apparatus for controlling a hazardous device. More particularly, but not exclusively, the present invention relates to an apparatus for controlling a hazardous device comprising a barrage unit comprising a pad sandwiched between first and second liner layers, the pad comprising an absorbent fibrous material and absorbent crystalline material; and, a container for holding a liquid, the container being dimensioned to receive the barrage unit. In a further aspect the present invention relates to a method of controlling a hazardous device. More particularly, but not exclusively the method according to the invention comprises the steps of providing the above apparatus, arranging the hazardous device and barrage unit in the container and then adding a liquid to the container such that it is absorbed by the barrage unit.

Hazardous devices in vehicles, in particular aircraft, are becoming an increasing problem. Of particular concern are batteries for mobile phones, laptops and the like. Such batteries can become hot and so risk causing a fire. In extreme cases they can explode. Despite this effective measures of containing such hazardous devices are often not available to the crew. This is particularly the case on aircraft. Whilst blast or fire containing blankets are known they tend to be heavy and bulky. On aircraft both weight and space are at a premium and because of this such blankets are typically not carried on aircraft.

The present invention seeks to overcome the problems of the prior art.

Accordingly, in a first aspect the present invention provides a method of controlling a hazardous device comprising the steps of

- providing a combination of a barrage unit and a container for holding a liquid, the container being adapted to receive the barrage unit, the barrage unit comprising at least one pad, the pad comprising an absorbent fibrous material and an absorbent crystalline material;
- arranging the hazardous device and barrage unit in the container with the barrage unit at least partially covering the hazardous device; and,
- adding a liquid to the container so that the barrage unit absorbs the liquid.

The barrage unit is stored on the aircraft in a dry state and so is light and takes up little space. If a hazardous device is identified the device and barrage unit are placed in the container and the barrage unit rapidly hydrated by the addition of a liquid. The barrage unit will typically absorb several hundred times its weight in liquid. The barrage unit will cool the hazardous device. It will also contain the blast if the device should explode. The barrage unit can be hydrated using liquids which are already carried on an aircraft such as water and soft drinks.

Preferably the pad is sandwiched between first and second liner layers.

The liquid can be added to the container before at least one of the hazardous device and barrage unit.

Preferably the container is a tray.

Preferably, the tray is a sealed container with the barrage unit pre-packed in the tray.

Preferably, the container is a bag.

The barrage unit can be shaped as a blanket.

Alternatively, the barrage unit can be shaped as a pouch for receiving the hazardous device.

Preferably the pouch comprises first and second side walls, each side wall comprising a pad.

Preferably, the absorbent crystalline material is a polymeric material

Preferably, the polymeric material is a superabsorbent polymer.

Preferably, the superabsorbent polymer is one or more polyacrylate or polyamide, preferably one of more polyacrylate or polyamide salts.

Preferably, the salt is one or more metal salt, preferably a sodium or potassium salt.

Preferably, the fibrous material is a cellulosic material, preferably pulp fibre.

Preferably, the liner Layers are a hydrophilic material, preferably cotton.

In a further aspect of the invention there is provided an apparatus for controlling a hazardous device comprising

- a barrage unit comprising at least one pad sandwiched between first and second liner layers, the pad comprising an absorbent fibrous material and an absorbent crystalline material; and,
- a container for holding a liquid, the container being dimensioned to receive the barrage unit.

The container can be a tray.

The container can be a bag.

The barrage unit can be shaped as a blanket.

The barrage unit can be shaped as a pouch.

The present invention will now be described by way of example only on not in any limitative sense with reference to the accompanying drawings in which FIG. 1 shows a barrage unit of an apparatus according to the invention;

FIG. 3(*b*) shows an apparatus of FIG. 3(*a*) with the barrage unit in the wet state;

Figure 1:
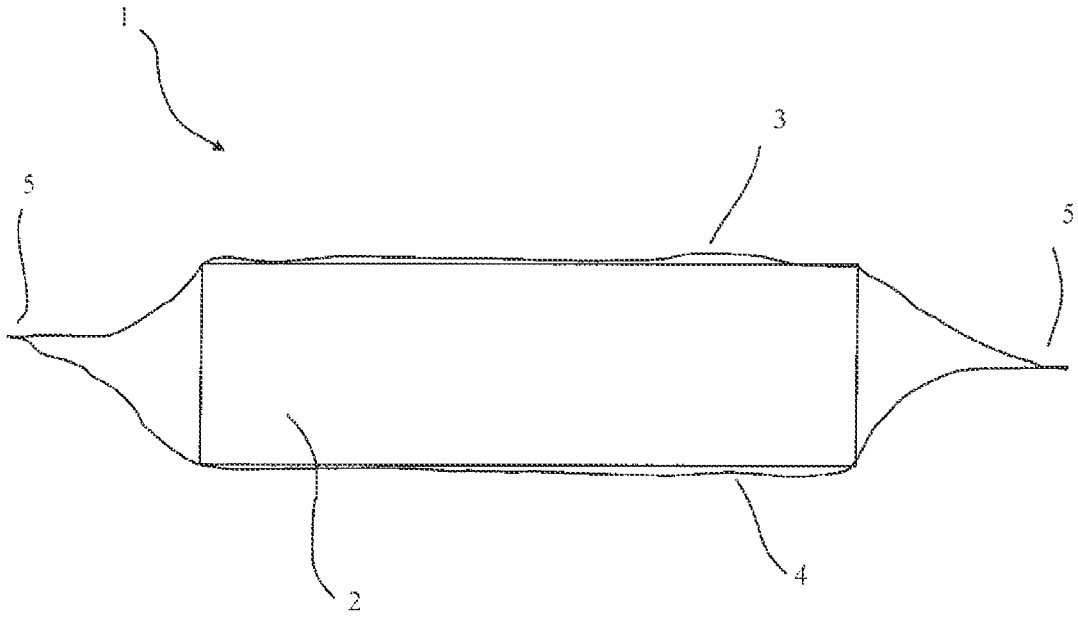

Shown in FIG. 1 is a barrage unit 1 of an apparatus according to the invention. The barrage unit 1 comprises a pad 2 sandwiched between first and second liner layers 3,4. The pad 2 comprises a mixture of an absorbent fibrous material and an absorbent crystalline material.

The pad 2 is typically rectangular although other shapes of pad such as square, round or oval are possible.

The absorbent crystalline material is preferably a polymeric material such as a superabsorbent polymer. A number of different superabsorbent polymers are available for example polyacrylates and or polyacrylamides, especially polyacrylate and/or polyacrylamide salts, such as alkali metal salts eg sodium or potassium metal salts. These types of substance can hold up to two hundred times their own weight of water as the crystals can form an absorbent gelling polymer when saturated with fluid. It is well understood by one skilled in the art that mixtures of superabsorbent polymers may be used.

Other materials are also used to make a superabsorbent polymer, such as a polyacrylamide copolymer, ethylene maleic anhydride copolymer, cross linked carboxy-methyl-cellulose, polyvinyl alcohol copolymers, cross linked polyethylene oxide and starch grafted copolymer of polyacrylonitrile.

The fibrous material preferably comprises a cellulosic material, for example a pulp fibre, such as a wood pulp or fibre crop material such as a cotton pulp or the like. There are numerous other fibre crop materials available and it will be appreciated by the person skilled in the art that a number of such materials and/or mixtures of such materials may be used, Preferably the fibrous material is biodegradable.

The ratio of absorbent crystalline material to absorbent fibrous material may vary and may depend on a number of factors such as the nature of the crystalline material eg the superabsorbent polymer and the nature of the fibrous material eg pulp material. Thus for example the fibrous material may comprise from 40% to 80% by weight, preferably from 50% to 70% by weight, more preferably 55% to 65% by weight, the crystalline material making all or a substantial portion of the remainder of the pad.

The liner layers 3,4 typically comprise a hydrophilic material such as cotton or fibrework. The upper and lower liner layers 3,4 are cut during manufacture around the pads 2 and then the edges 5 typically glued together. The layers 3,4 may be sealed together in other ways.

The pad 2 can be manufactured in a number of different ways. One approach is to simply mix the absorbent fibrous material and absorbent crystalline material together, either mechanically or by hand. A further approach is to lay the fibrous material and crystalline material down in alternating layers. A more preferred approach however is to flow the fibrous material into a rotating drum then then drop the crystalline material into the drum. Once thoroughly mixed the fibrous material and crystalline material are extruded from an aperture in the side wall of the drum onto a liner layer 3 in the form of a pad 2. A second liner layer 4 is then laid down on the first sealing the pad 2 therebetween. Manufacturing the pad 2 in this way distributes the crystalline material more evenly throughout the fibrous material. Pads 2 manufactured by this method tend to expand more quickly and evenly than pads manufactured by other methods.

Figure 2:
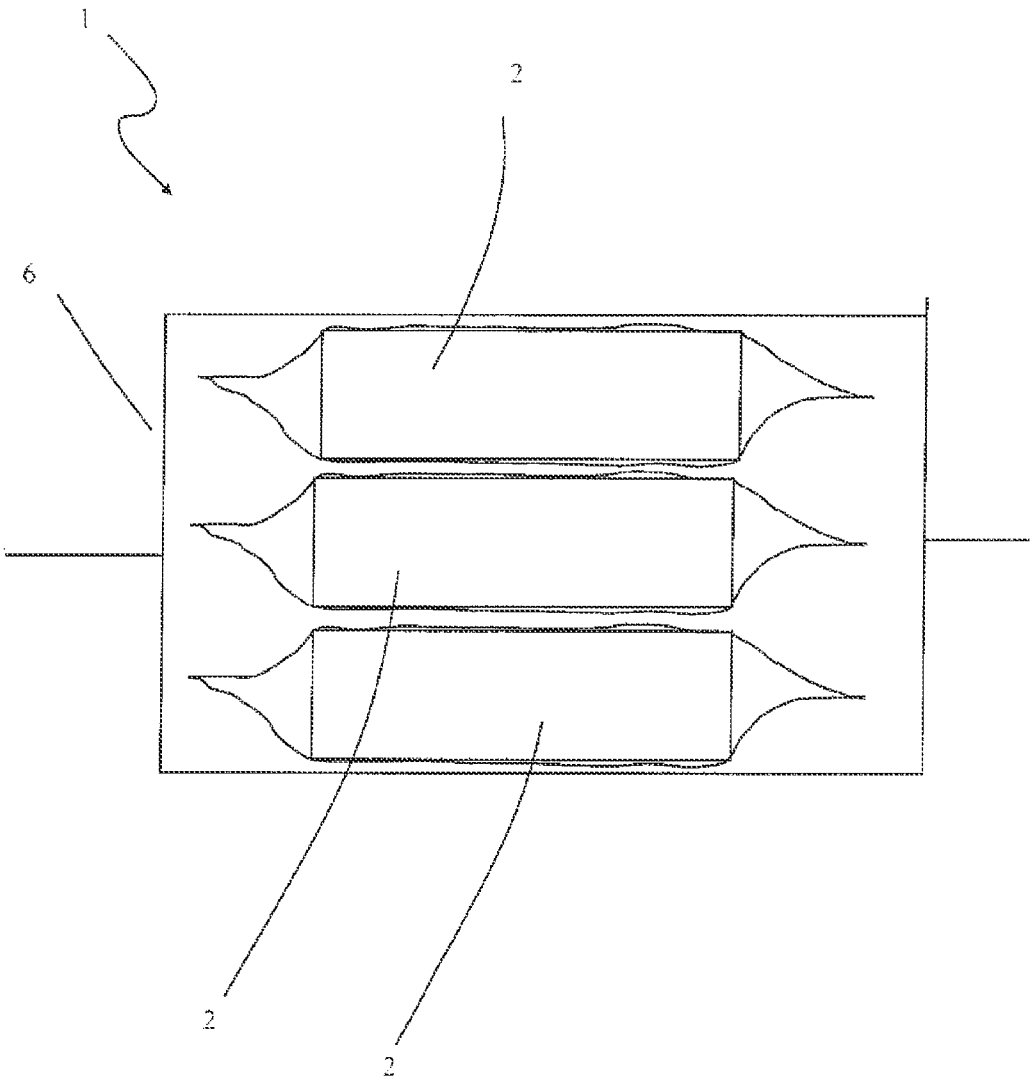
FIG. 2 shows a second embodiment of a barrage unit of an apparatus according to the invention.

Shown in FIG. 2 is a further example of a barrage unit 1 according to the invention. This barrage unit 1 comprises a plurality of pads 2 in a sack 6. The sack 6 is any conventional material known as sacking material. It may be a natural material or a synthetic material or a combination of such materials. An example of a natural material is a jute fabric. An example of a synthetic material is a loosely woven polypropelene. A jute fabric is preferred because of; inter alia, its hydrophilicity. The sack 6 may be biodegradable.

Figure 3A:
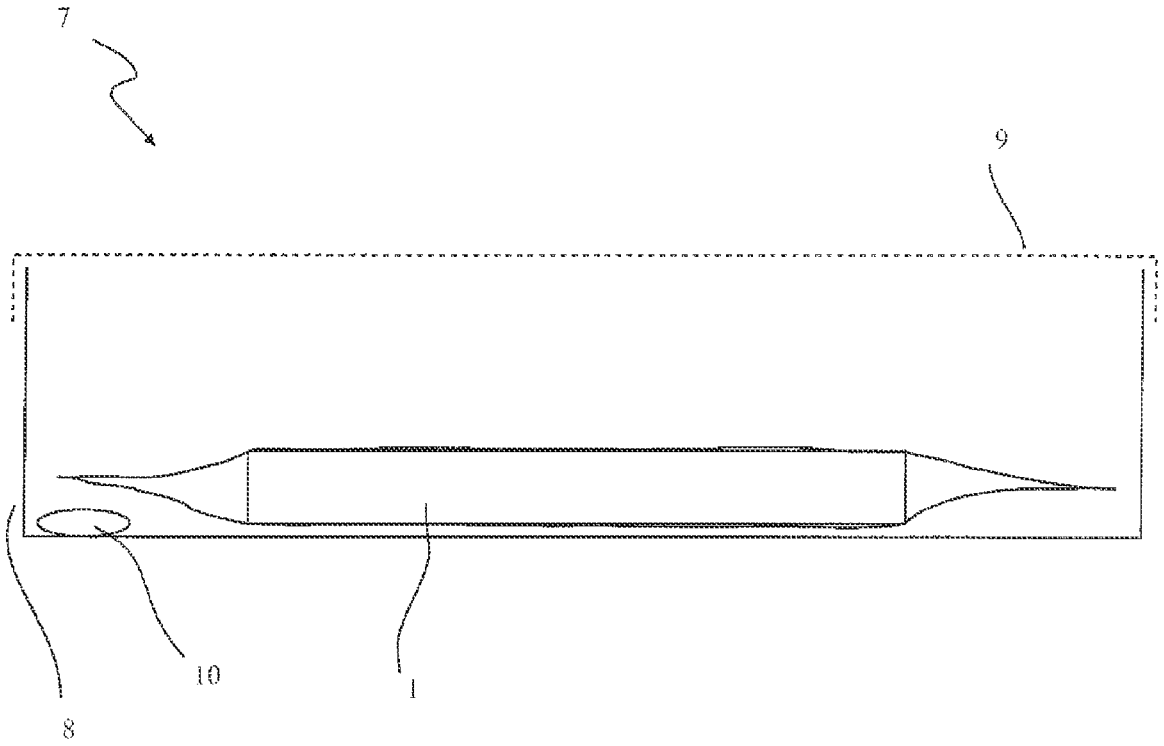
FIG. 3(*a*) shows an apparatus according to the invention with the barrage unit in the dry state.
Figure 3B:
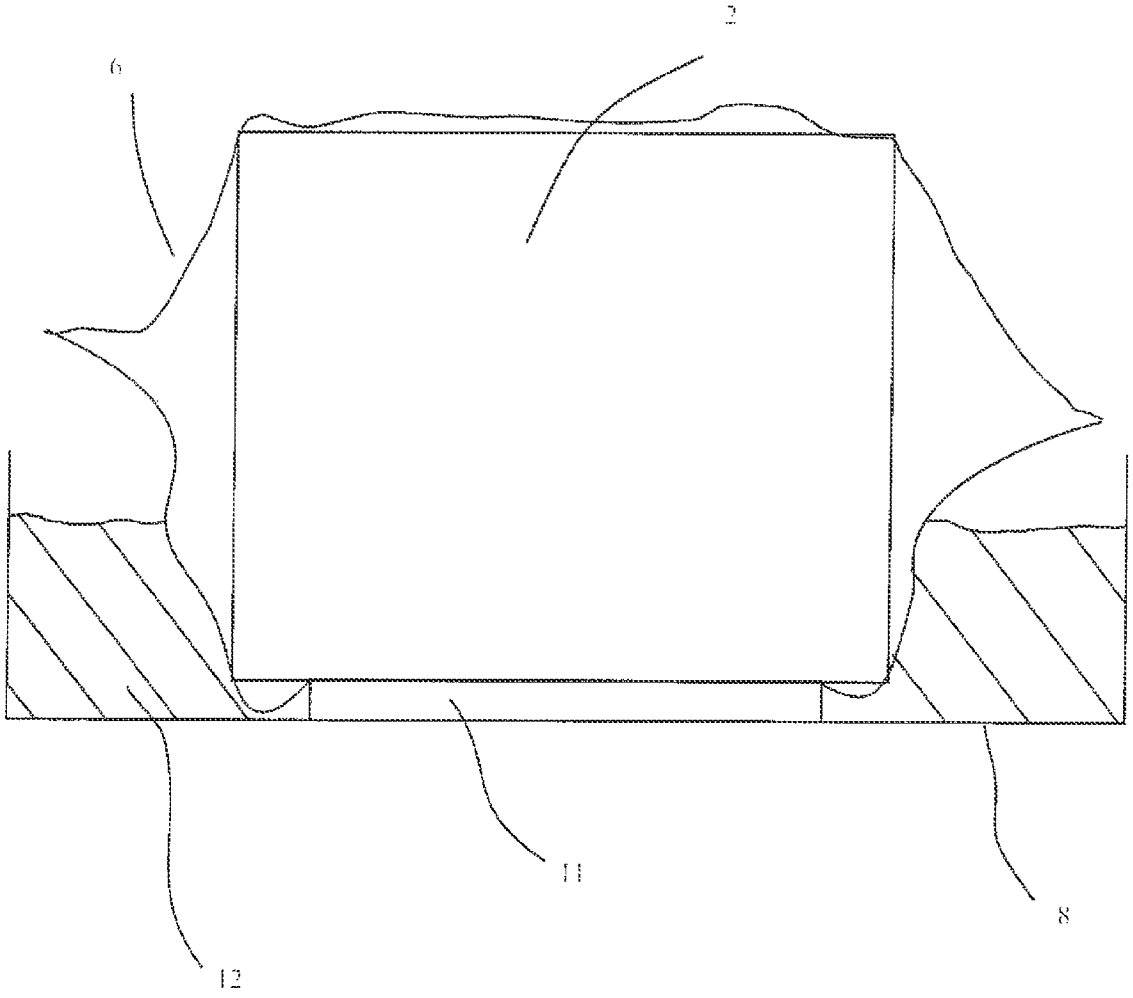

Shown in FIG. 3(*a*) is an apparatus 7 according to the invention. The apparatus 7 comprises a barrage unit 1 as described above and shaped as a blanket in combination with a container 8 for holding a liquid which in this embodiment is a tray 8, The barrage unit 1 is in the dry state. The tray 8 is dimensioned to receive the barrage unit 2. Typically the tray 8 is sealed by a water impermeable film 9 stretched across the mouth of the tray 8 as shown. The tray 8 may also comprise a sachet 10 of a water absorbing material to keep the barrage unit 2 dry.

In use the barrage unit 1 and tray 8 are loaded on to a vehicle, for example an aircraft where it is stored until needed. In the dry state the barrage unit 1 is relatively thin and light and does not take up much volume.

When a potentially hazardous device 11 (for example a lithium, battery for a mobile device) is identified the film 9 is removed from the tray. The hazardous device 11 is placed in the tray 8 and covered, at least partially, with the barrage unit 1. Liquid 12 is poured into the tray 8. The liquid can be any liquid commonly carried by the aircraft, for example drinking water, soft drinks, wines etc. The barrage unit 1 rapidly absorbs the liquid 12 and swells as shown in FIG. 3(*b*). It may be necessary to add the liquid 12 to the tray several times before the barrage unit 1 reaches its full volume.

The barrage unit 1 cools the hazardous device 11 and will also contain any flames if it should ignite. It also contains any blast fragmentation pieces if the hazardous device 11 should explode.

The barrage unit 1 may not be stored in the tray 8. One or more barrage units 1 may be stored separately from the tray 8 if preferred.

The barrage unit 1 has other secondary uses. When in the dry state the barrage unit 1 can be used to mop up spillages of liquids or toilet overflow. It can also be used to plug leaks.

The apparatus 7 can be used in any vehicle but particularly those where weight and space are at a premium. Other examples are trains and boats.

Figure 4A:
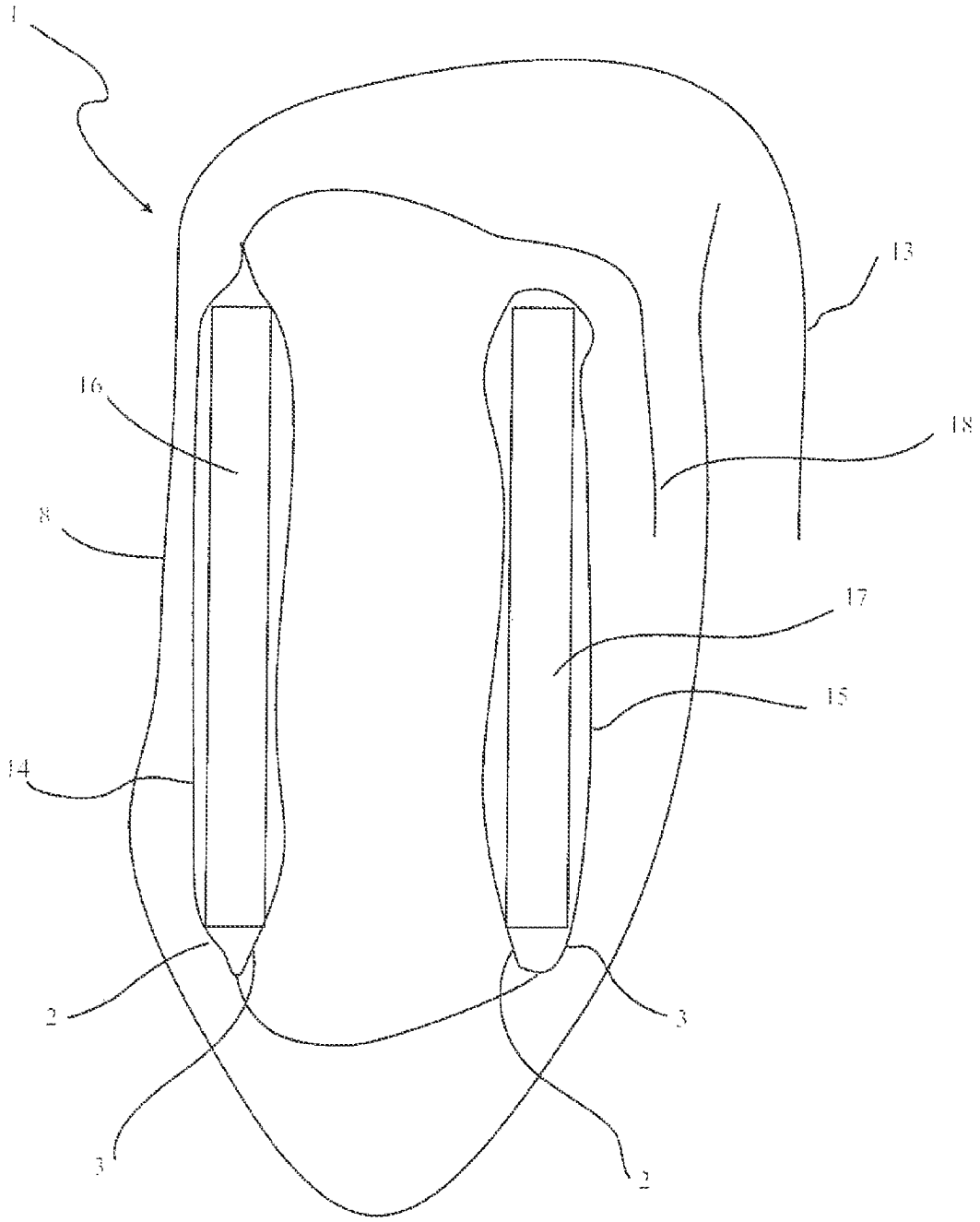
FIG. 4(*a*) shows a further embodiment of an apparatus according to the invention; and, FIG. 4(*b*) shows the apparatus of FIG. 4(*a*) in the wet state.
Figure 4B:
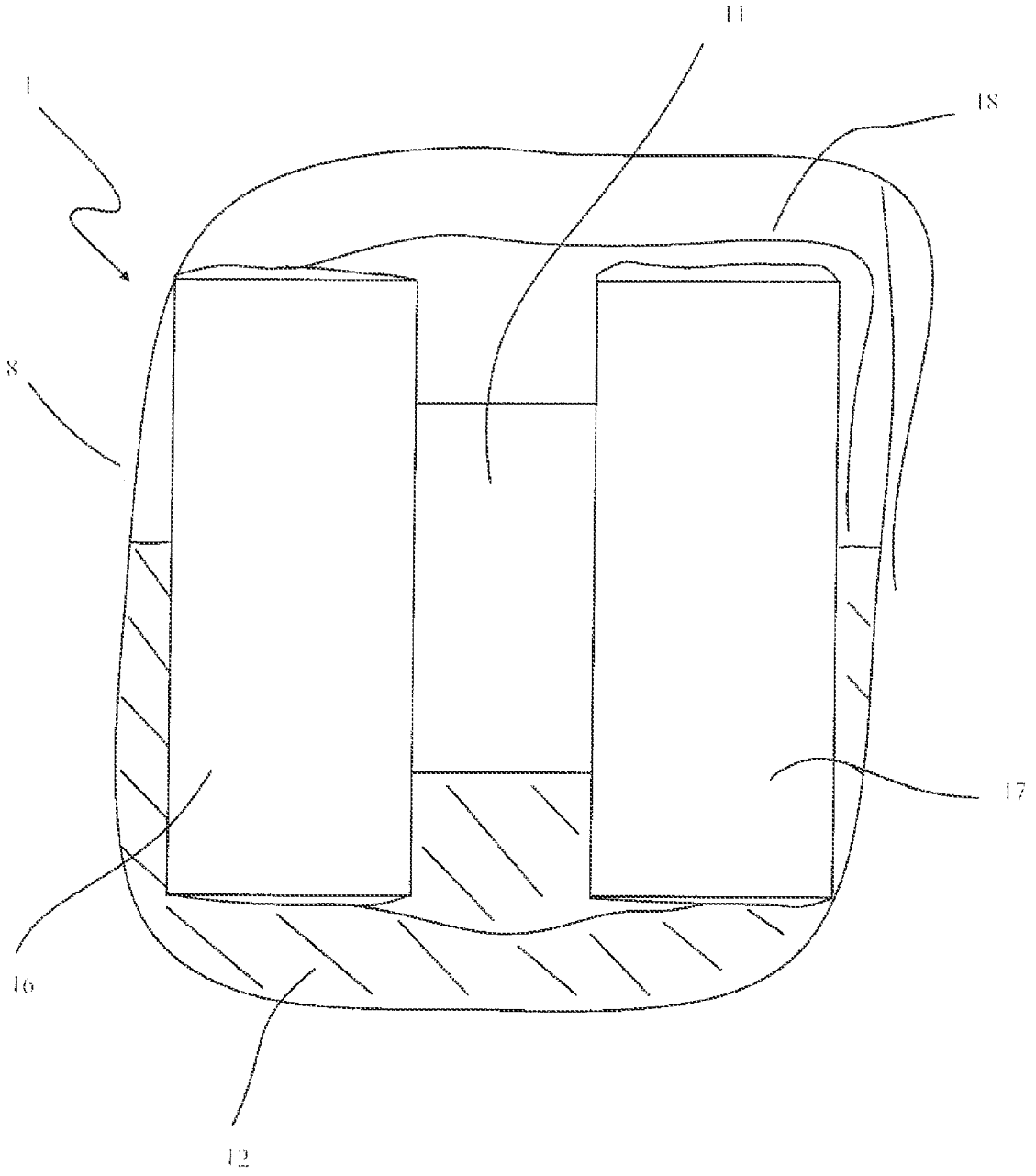

Shown in FIG. 4(*a*) is a further embodiment of an apparatus according to the invention. In this embodiment the container 8 is a bag 8 having a closeable flap 13. The bag 8 is typically a plastics material impermeable to liquids. The apparatus further comprises a barrage unit 1. The barrage unit 1 is shaped as a pouch dimensioned to receive the hazardous device. Each side wall 14, 15 of the pouch 1 comprises at least one pad 16, 17 sandwiched between finer layers 2,3. The barrage unit 1 has a closeable flap 18.

FIG. 4(*b*) shows the apparatus of FIG. 4(*a*) in use. When a hazardous device 11 is identified it is placed in the pouch 1 and the flap 18 closed. The barrage unit 1 is then placed in the bag 8. The bag 8 is filled with a liquid 12 and the flap 13 closed. The pads 16,17 expand by absorbing the liquid 12 as shown. In this state the apparatus cools the hazardous device 11 and again contains any blast fragments.

In the above described embodiments the liquid is added as a last step. In alternative embodiments according to the invention the liquid is added to the container at different points in the method. As an example where the barrage unit is a pouch and the container is a bag the liquid may be added to the bag, the device added to the pouch and the pouch placed in the bag. Alternatively, the liquid and the pouch may be added to the bag and then finally the device added to the pouch in the bag.

A typical hazardous device is a battery such as a lithium battery. Batteries can overheat and possibly explode. The liquid employed in the device will cool the battery and prevent it from igniting, if the battery does explode the apparatus will control the blast. There are other types of hazardous device which may occasionally be found on an aircraft. These include munitions such as bombs or bullets. Again, the liquid may prevent the munitions from exploding. If the munitions do explode the apparatus will contain the blast.

The invention claimed is:

1. A system for controlling a hazardous device by cooling the hazardous device comprising:

a pouch shaped barrage unit comprising first and second side walls, each sidewall comprising a pad, each pad comprising an absorbent fibrous material and a superabsorbent polymer;

a container being impermeable to liquids and dimensioned to receive the barrage unit;

a liquid held within said container and absorbed by said barrage unit, wherein the absorption of said liquid by said barrage unit causes each pad to expand, the barrage unit and container being dimensioned such that as the pads expand they abut the hazardous device so cooling the hazardous device.

2. An apparatus for controlling a hazardous device by cooling the hazardous device comprising:

a pouch shaped barrage unit comprising first and second side walls, each sidewall comprising a pad, each pad comprising an absorbent fibrous material and a superabsorbent polymer; and a container for holding a liquid, the container being impermeable to liquids and dimensioned to receive the barrage unit, wherein the liquid held within said container is absorbed by said barrage unit, and wherein the absorption of said liquid by said barrage unit causes each pad to expand, the barrage unit and the container being dimensioned such that as the pads expand they abut the hazardous device so cooling the hazardous device.

3. An apparatus as in claim 2, wherein each pad is sandwiched between first and second liner layers of a respective one of the first and second side walls.

4. An apparatus as in claim 3, wherein each of the first and second liner layers comprises a hydrophilic material.

5. An apparatus as in claim 4, wherein the hydrophilic material is cotton.

6. An apparatus as in claim 5, wherein the superabsorbent polymer is one or more polyacrylate or polyamide.

7. An apparatus as in claim 6, wherein the one or more polyacrylate or polyamide is one or more polyacrylate salt or polyamide salt.

8. An apparatus as in claim 7, wherein the one or more polyacrylate salt or polyamide salt is one or more polyacrylate metal salt or polyamide metal salt.

9. An apparatus as in claim 8, wherein the metal of the one or more polyacrylate metal salt or polyamide metal salt is sodium or potassium.

10. An apparatus as in claim 2, wherein the absorbent fibrous material is a cellulosic material.

11. A method of controlling a hazardous device by cooling the hazardous device comprising the steps of:

providing a combination of a barrage unit and a container for holding a liquid, the container being shaped as a bag impermeable to liquids and adapted to receive the barrage unit, the barrage unit being shaped as a pouch for receiving the hazardous device, the pouch comprising first and second side walls, each side wall comprising a pad, each pad comprising an absorbent fibrous material and a superabsorbent polymer;

arranging the hazardous device and pouch shaped barrage unit in the container with the hazardous device within the pouch shaped barrage unit;

adding a liquid to the container so that the barrage unit absorbs the liquid, causing the pads to expand, the barrage unit and container being dimensioned such that as the pads expand they abut the hazardous device so cooling the hazardous device.

12. A method as claimed in claim 11, wherein each pad is sandwiched between first and second liner layers of a respective one of the first and second side walls.

13. A method as claimed in claim 12, wherein each of the liner layers comprises a hydrophilic material.

14. A method as claimed in claim 13, wherein the hydrophilic material is cotton.

15. A method as claimed in claim 11, wherein the liquid is added to the container before the step of arranging the hazardous device and pouch shaped barrage unit in the container.

16. A method as claimed in claim 11, wherein the superabsorbent polymer is one or more polyacrylate or polyamide.

17. A method as claimed in claim 16, wherein the one or more polyacrylate or polyamide is one or more polyacrylate salt or polyamide salt.

18. A method as claimed in claim 17, wherein the fibrous material is a cellulosic material.

19. A method as claimed in claim 17, wherein the one or more polyacrylate salt or polyamide salt is one or more polyacrylate metal salt or polyamide metal salt.

20. A method as claimed in claim 19, wherein the metal of the one or more polyacrylate metal salt or polyamide metal salt is sodium or potassium.

* * * * *